US012449183B2

(12) United States Patent
Iyengar et al.

(10) Patent No.: US 12,449,183 B2
(45) **Date of Patent: *Oct. 21, 2025**

(54) METHOD AND APPARATUS FOR DETERMINING FREEZER STATUS

(71) Applicant: Elemental Machines, Inc., Salem, NH (US)

(72) Inventors: Sridhar Iyengar, Salem, NH (US); Casey Peters, Caldwell, NJ (US)

(73) Assignee: Elemental Machines, Inc., Cambridge, MA (US)

( * ) Notice: Subject to any disclaimer, the term of this patent is extended or adjusted under 35 U.S.C. 154(b) by 278 days.

This patent is subject to a terminal disclaimer.

(21) Appl. No.: 18/095,700

(22) Filed: Jan. 11, 2023

(65) Prior Publication Data

US 2023/0280082 A1 Sep. 7, 2023

Related U.S. Application Data

(63) Continuation of application No. 16/673,204, filed on Nov. 4, 2019, now Pat. No. 11,561,037.

(60) Provisional application No. 62/755,504, filed on Nov. 4, 2018.

(51) Int. Cl.
*F25D 21/00* (2006.01)
*F25D 21/04* (2006.01)

(52) U.S. Cl.
CPC ..... *F25D 21/006* (2013.01); *F25D 21/008* (2013.01); *F25D 21/04* (2013.01); *F25D 2700/122* (2013.01); *F25D 2700/14* (2013.01)

(58) Field of Classification Search
CPC ..... F25D 21/006; F25D 21/008; F25D 21/04; F25D 2700/122; F25D 2700/14; F25D 2700/02; F25D 29/008
See application file for complete search history.

(56) References Cited

U.S. PATENT DOCUMENTS

| | | | | |
|---|---|---|---|---|
| 2,249,466 | A | 7/1941 | Fields | |
| 4,481,787 | A | 11/1984 | Lynch | |
| 4,535,599 | A | 8/1985 | Besson et al. | |
| 5,255,530 | A * | 10/1993 | Janke | F25D 17/065 62/181 |
| 5,806,321 | A | 9/1998 | Bendtsen et al. | |
| 5,907,955 | A | 6/1999 | Park | |
| 5,927,083 | A | 7/1999 | Guo et al. | |
| 6,058,724 | A | 5/2000 | Park | |
| 8,725,455 | B2 | 5/2014 | Kriss | |
| 2005/0086952 | A1 | 4/2005 | Nonaka et al. | |
| 2005/0120727 | A1 | 6/2005 | Flinner et al. | |
| 2007/0012054 | A1 | 1/2007 | Schenk et al. | |

(Continued)

FOREIGN PATENT DOCUMENTS

| | | |
|---|---|---|
| CA | 2962537 | 3/2020 |
| CN | 107940873 A | 4/2018 |

(Continued)

*Primary Examiner* — Nelson J Nieves
(74) *Attorney, Agent, or Firm* — Anderson Patent Law Firm

(57) ABSTRACT

A method for determining a time frame for when a freezer having a compressor should be defrosted include the steps of measuring compressor cycling over time, determining a change in compressor cycling over time, and determining from the change in in compressor cycling over time determined a time frame for when the freezer should be defrosted.

14 Claims, 15 Drawing Sheets

Freezer temperature over the course of approximately a year

(56) References Cited

U.S. PATENT DOCUMENTS

| | | | | |
|---|---|---|---|---|
| 2008/0223049 | A1 | 9/2008 | Every | |
| 2011/0036105 | A1 | 2/2011 | Feng et al. | |
| 2011/0067423 | A1 | 3/2011 | Kawamukai et al. | |
| 2011/0088415 | A1 | 4/2011 | Lacey et al. | |
| 2012/0198863 | A1 | 8/2012 | Hall | |
| 2014/0165630 | A1 | 6/2014 | Langenberg et al. | |
| 2014/0352335 | A1 | 12/2014 | Anderson | |
| 2015/0184924 | A1 | 7/2015 | Vie et al. | |
| 2018/0106520 | A1 | 4/2018 | Wallis et al. | |
| 2018/0340729 | A1 | 11/2018 | Sugar et al. | |
| 2021/0108844 | A1* | 4/2021 | Ryu | F04B 49/12 |
| 2021/0215419 | A1* | 7/2021 | Dalmolin | F25B 49/005 |

FOREIGN PATENT DOCUMENTS

| | | | |
|---|---|---|---|
| CN | 107940874 | A | 4/2018 |
| DE | 41 15 359 | A1 | 11/1992 |
| DE | 44 18 874 | A1 | 3/1996 |
| EP | 0 721 092 | A1 | 7/1996 |
| EP | 2717002 | A1 | 4/2014 |
| EP | 2757335 | A1 | 7/2014 |
| EP | 3587964 | A1 | 1/2020 |
| EP | 3587962 | B1 | 12/2020 |
| JP | 2001241825 | A | 9/2001 |
| KR | 100536284 | B1 | 3/2006 |
| WO | 2012/089454 | A2 | 7/2012 |

* cited by examiner

Figure 1 -- Freezer temperature over the course of approximately a year

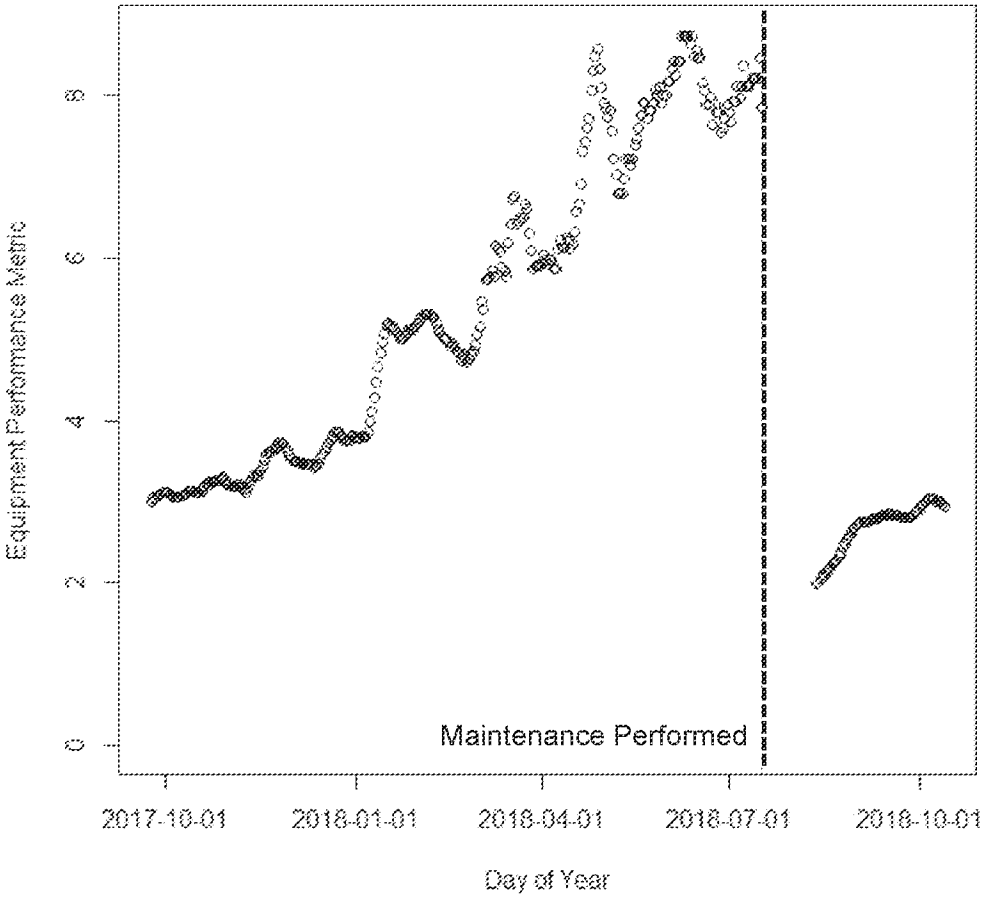
Figure 10 – Filtered and smoothed compressor cycle period over time.

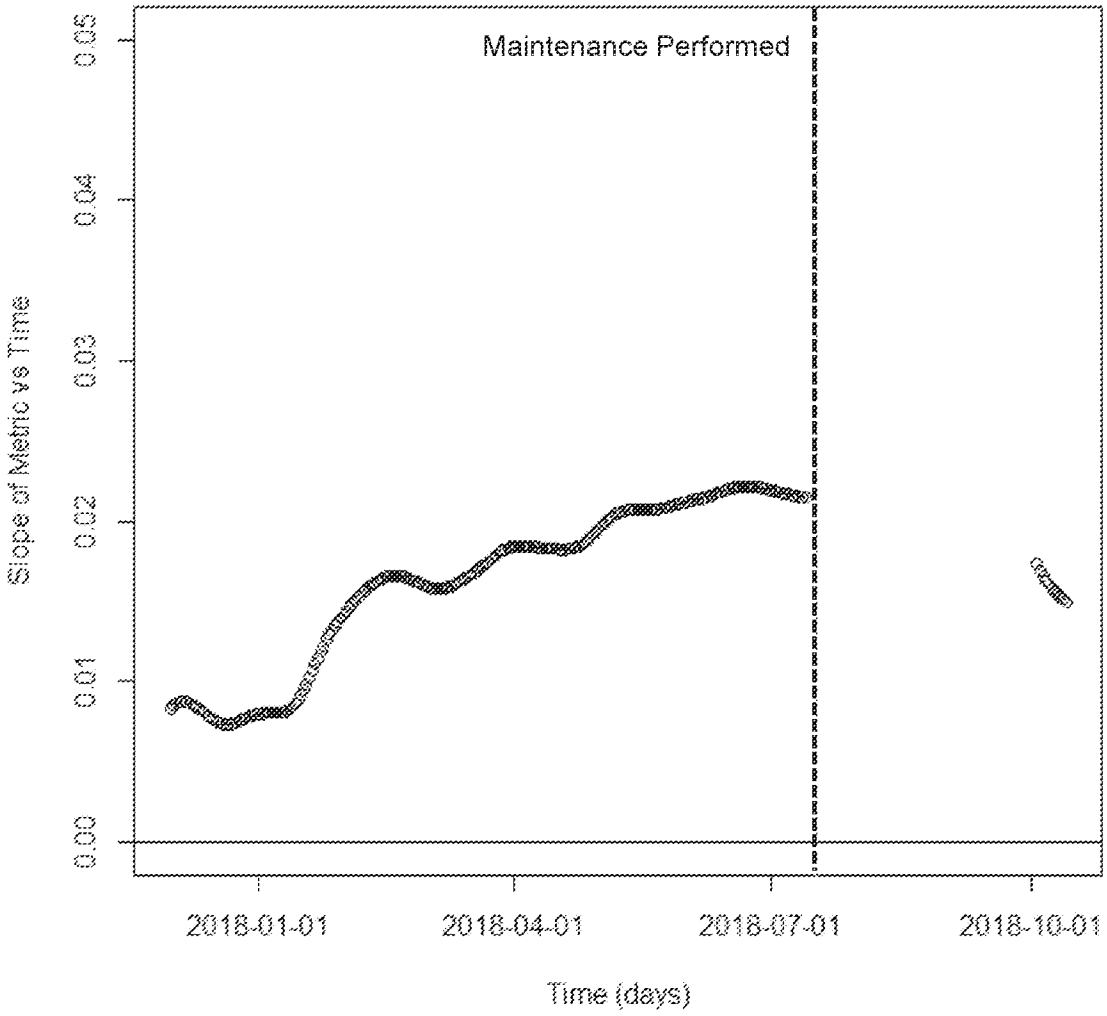
*Figure 11 – Slope of compressor cycle vs day. A value of 0.01 indicates an increase in compressor cycle period of 1hr every 100 days.*

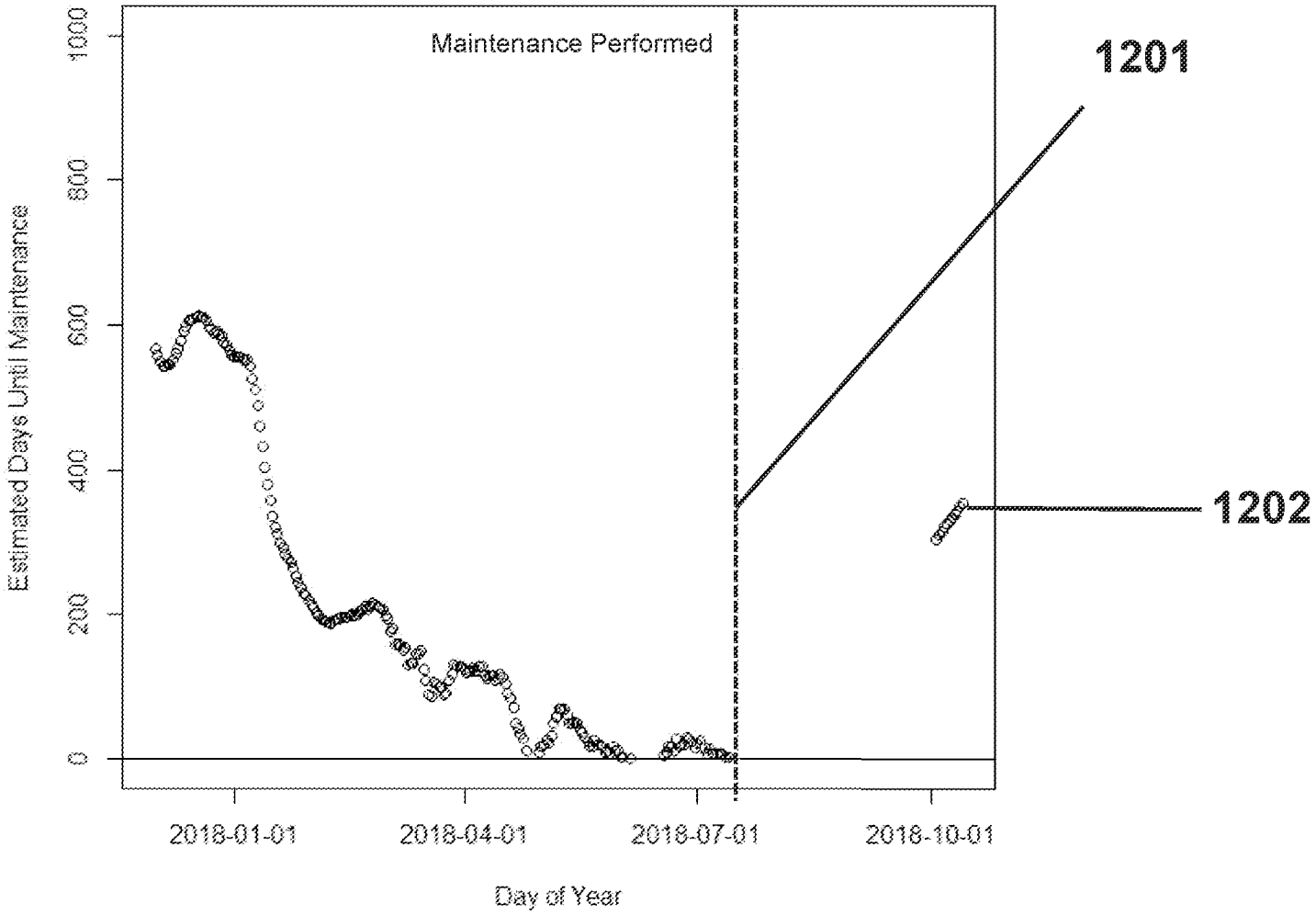
*Figure 12 -- Predicted number of days until the next defrost is needed.*

METHOD AND APPARATUS FOR DETERMINING FREEZER STATUS

CROSS-REFERENCE TO RELATED APPLICATIONS AND PRIORITY

This application is related to and claims the benefit of U.S. Prov. Application Ser. No. 62/755,504 filed on Nov. 4, 2018 which is incorporated herein by reference for all purposes.

This application is also related to US applications entitled (1) "Method and Apparatus for Local Sensing" which received U.S. Provisional Application Ser. No. 62/739,419; (2) "Systems and methods to integrate environmental information into measurement metadata in an Electronic Laboratory Notebook Environment" which received U.S. Provisional Application Ser. No. 62/739,427 and U.S. application Ser. No. 16/589,347; and (3) "Method and Apparatus for Process Optimization" which received U.S. Provisional Application Ser. No. 62/739,441 and U.S. application Ser. No. 16/589,713. These applications are incorporated in their entireties herein by reference for all purposes.

Any external reference mentioned herein, including for example websites, articles, reference books, textbooks, granted patents, and patent applications are incorporated in their entireties herein by reference for all purposes.

BACKGROUND OF THE INVENTION

Freezers are used in home settings to keep food items frozen and in laboratory/manufacturing settings to keep samples, specimens, materials, ingredients, reactants etc. frozen. Freezers for home use usually operate at temperatures from −18 C to −35 C. Laboratory/manufacturing freezers operate in similar ranges but can also operate at significantly lower temperatures such as in the −20 C to −150 C range (e.g. −80 C). Cryogenics principles take over at temperatures below −150 C.

Over time, these freezers can acquire ice build up on interior surfaces. Ice also builds up along the door edge and can break the door seal thereby causing the freezer to have an air gap, which can result in more ice build up due to humid air entering the interior of the freezer. As ice builds up on interior surface and/or causes air gap failures, freezer performance can degrade which results in reduction in the efficiency of the freezer and an increase in compressor stress. Furthermore, as ice builds up in freezer can lead to eventual failure of the freezer's ability to maintain its operating temperature and ability to keep contents at desired temperatures.

Currently freezer defrosts are performed when visual inspection of the freezer reveals a need for defrost or in compliance with preset freezer defrost schedules (e.g. e.g. at every week, every month, every six months, every year, etc.). During each defrost event, the contents of the freezer are transferred to a different freezer OR the contents are discarded while the freezer is shut down, warmed up, and defrosted. Freezer defrosts are time, labor, resource and even a material intensive events which is why they are often delayed as long as possible (even if scheduled) and oftentimes delayed until freezer failure.

Improvements in determining when a freezer needs to be defrosted are strongly desired.

BRIEF SUMMARY OF THE INVENTION

The present invention provides solutions to the problems noted above. In a first embodiment, the present invention provides a method for determining a time frame for when a freezer having a compressor should be defrosted. The method includes the steps of: (a) determining/observing/measuring compressor cycling over time (e.g. as a function of time); (b) determining from the compressor cycling observed/measured in step (a) a change in compressor cycling over time; and (c) determining from the change in in compressor cycling over time determined in step (b) a time frame for when the freezer should be defrosted.

In another embodiment, the present invention provides a system comprising: (a) a freezer having compressor; (b) sensor means for observing compressor cycling: and (c) programmed circuitry for receiving signals from the (b) sensor means, wherein the circuitry comprises instructions for performing any of the methods herein described.

In a further embodiment, a printed set of instructions and/or a computer/server/data base/file hierarchy comprising a programmed processor AND/OR programmed circuitry comprising instructions for performing the method of any of the methods herein described.

BRIEF DESCRIPTION OF THE DRAWING

FIG. 9 B shows ambient temperature in a room containing a freezer.

FIG. 9 C shows ambient relative humidity in a room containing a freezer.

FIG. 10 shows the compressor period data from FIG. 9A after data conditioning.

FIG. 11 shows the slope of a compressor period vs. day.

FIG. 12 shows a predicted number of days until the next defrost is needed.

FIG. 13 C shows the compressor cycle period increases at a faster rate.

FIG. 14A shows how ambient humidity can impact compressor cycling.

FIG. 14B shows how frequency of door opening events can impact compressor cycling.

FIG. 14C shows how both ambient humidity and frequency of door opening events can impact compressor cycling.

DETAILED DESCRIPTION OF THE INVENTION

Figure 1:
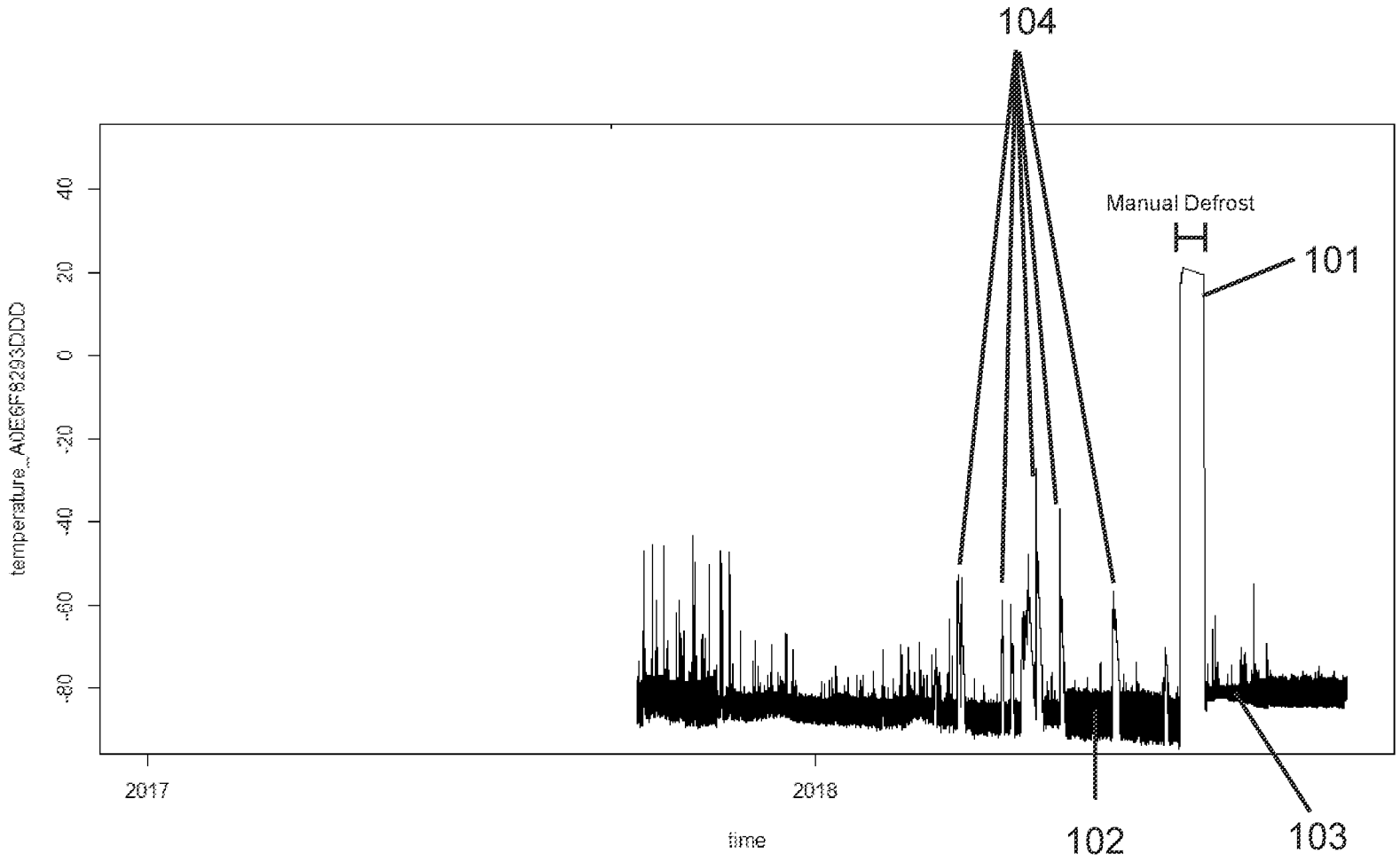
FIG. 1 is a graph of freezer temperature data over time.

The present invention is directed to and solves problems in the art with respect to freezer maintenance and associated maintenance routines. In particular, the present invention provides improvements in determining (or predicting) when a freezer needs to be defrosted and accordingly provides methods and systems that can determine, ascertain and/or predict and alert a user as to when a freezer should be defrosted.

The present Inventors have discovered that valuable information can be obtained from freezers having compressors or other systems that have an active cooling period and a resting period, for example thermoelectric materials such as Peltiers or thermoelectric coolers (as described in https://en.wikipedia.org/wiki/Thermoelectric_cooling), each referred to as a "compressor" or collectively referred to as "compressors". The present Inventors have developed systems and methods of gathering and using this valuable information in determining, ascertaining and/or predicting when a freezer should/needs to be defrosted. In particular, the present inventors have discovered that when ice builds up on the interior surface of the freezer the compressor cycling signature/trace changes as a function of time and as a function of ice build up over time. It has now been discovered that as ice builds up in a freezer the period (p) of a compressor cycle (e.g. from when the compressor turns on, through when the compressor turns off until immediately before the compressor turns on again, etc.) lengthens/increases. Accordingly, the frequency (f=1/p) of compressor cycles decreases as ice builds up in the freezer.

Furthermore, it has been found that the time frame in which the compressor is "on" compared to when the compressor is "off" during each cycle can change as ice builds up in the freezer. For example the duration in which the compressor is "on" appears to increase during compressor cycling as time progresses and as ice builds up on interior surface of the freezer. The buildup of ice in the freezer therefor can increase stress on the freezer leading to decreased performance and increase compressor failure rates.

Without being bound by a particular mechanism of operation, it is believed that the buildup of ice on interior surfaces has at least a two-fold effect. First, the ice acts as an insulator thereby further insulating the interior enclosed space of the freezer (e.g. the freezer becomes better insulated and needs less cooling load=less compressor cycles). Second, temperature sensors used to control compressor operations are typically mounted directly on the interior surface of the freezer or in proximity to the interior surface. As the ice layer builds over the sensors, sensor operation is inhibited as the sensor is insulated from direct measurement of the actual temperature of the freezer space. Accordingly, as the ice layer builds over the sensor actual measurement of ambient conditions within the freezer is inhibited and delayed thereby prolonging the duration of the compressor cycle and the duration of time the compressor is "on" during said cycle. This also leads to greater temperature swings within the freezer space.

Understanding the above-described discoveries, the present invention provides systems and methods that can determine, ascertain and/or predict when a freezer should be defrosted. In a first embodiment, the method includes the steps of: (a) determining/observing/measuring compressor cycling over time (e.g. as a function of time); (b) determining from the compressor cycling observed/measured in step (a) a change in compressor cycling over time; and (c) determining from the change in in compressor cycling over time determined in step (b) a time frame for when the freezer should be defrosted.

The ways in which compressor cycling is (a) observed over time are numerous and not limited herein. For example, compressor cycling can be measured over time by measuring and analyzing electrical input (via a voltage or current meter) to the compressor over time; measuring and analyzing a portion of the interior temperature (via a thermocouple or temperature sensor) of the freezer over time, preferably in the vicinity of the compressor; measuring and analyzing the ambient temperature (via a thermocouple or temperature sensor) of the room surrounding the compressor over time; measuring and analyzing the temperature (via a thermocouple or temperature sensor) of the compressor over time; measuring and analyzing sound indicative of compressor cycles over time; and/or measuring and analyzing any vibration (via a microphone, waveguide, piezoelectric sensor, accelerometer, or other vibration, movement and/or sound sensor etc.) that may be indicative of compressor cycles over time. Observing or measuring anyone of these variables over time provides either direct or indirect information regarding the on/off status and therefore provides either direct or indirect observation regarding compressor cycling over time. For example, a temperature sensor placed in, on, or near the compressor reveals an elevated temperature which is indicative of the compressor being "on" and a cooler temperature when the compressor is "off". As another example a temperature sensor placed in the freezer space reveals a reduction in temperature which is indicative of the compressor being "on" and a rise in temperature when the compressor is "off". As compressor cycles lengthen and as ice builds up, the temperature profile of the compressor or freezer as measured by these sensors will reveal longer compressor period.

Measurement of any of these variables can be accomplish by placing an appropriate sensor and/or sensor systems in an appropriate location(s) to make the appropriate measurement. The sensor and/or sensor systems can continuously or intermittently transfer sensor data and/or variables to a sensor control unit, router, computer, server etc. where it can then be collected and analyzed. Exemplary sensor and data collection/analysis systems are described in U.S. Provisional Application Ser. No. 62/739,427 and its related regular utility filing, incorporated herein by reference for all purposes. Furthermore, ambient and local conditions such as temperature, noise, humidity etc. can be measured by sensor packages sold under the tradename ELEMENT and transferred to a data hierarchy system such as described at https://elementalmachines.io/. The data hierarchy system preferably includes programmed hardware containing instructions for performing all of the method steps of the methods and systems described herein.

The compressor cycling information observed in step (a) described above is analyzed to (b) determine if, when, and how (e.g. magnitude of change) the compressor cycles change over time. From this (b) determined change in compressor cycling over time (c) a time frame can be determined for when the freezer should be defrosted. Steps (b) and/or (c) can be accomplished via mathematical or statistical analysis or modeling (e.g. via mathematical relationship (FFT, linear regression analysis etc.), plotting, multi-dimensional vectors, multi-dimensional arrays, or tensor).

Mathematical or statistical analysis or modeling of compressor cycling changes over time can provide an immediate indication that freezer defrost is required and/or can provide an estimated time period of when the compressor cycling reaches a point of where defrost of the freezer is required.

Mathematical or statistical analysis or modeling can be a direct comparison of a measured variable indicative of compressor cycling to a reference/stored/baseline/threshold/expected/calculated value (e.g. in a lookup table, etc.). For example the reference value to be compared against the measured variable could be some percentage of a known value indicative of freezer frost levels. For example when it is determined that the measured variable indicative of compressor cycle is greater than, equal to, or less than a reference value in a lookup table (or some function of a reference value in a lookup table such as 33%, 50%, 66%, 75%, 90°/%, 125%, 150%, 200%, 300%, 400%, 1000% etc. of some variable), it is known that it is time to perform a defrost or that freezer function is compromised or close to be compromised, etc.

In some embodiments, the time frame determined in step (c) is from the present time/now (e.g. immediately) to sometime in the future (e.g. the next 0.5, 1, 24, 48, 72 hours, 1 week, 1 month or less, 1 year etc.). In additional embodiments, once the time frame for defrost is determined and alert (e.g. message/alert/report/warning/information) can be generated and/or sent to a user or a data file/server/computer/personal electronic device etc.) regarding a value representative of the determined time frame for when the freezer should be defrosted. Such alert generation and transmissions protocols are not particularly limited and could include telephone call, text message, email message, and/or other electronic, audible or visual communication protocols.

Mathematical or statistical analysis or modeling can likewise provide an estimation of a time frame in the future when a freezer should be defrosted. For example, the analysis of the change of compressor cycle over time can provide a linear or more complex projection of a date range where the freezer should be defrosted. In this embodiment, the rate of change of the compressor cycle over time can be determined and future projections of (1) the compressor cycling, (2) timeframe for defrost or defrost schedule, or (3) some other metric can then be extrapolated. From these future projections, an equipment performance metric can be assigned (for example when the compressor cycle reaches 50, 70, 90, 110, 125, 150, 200, 300, 400, 1000% etc. of an expected/normal value of a measured variable or compressor period or frequency, defrost is required). Using the future projections, a future time period can then be estimated for when a freezer defrost should be done and an associated alert can be provided to a user.

In further preferred embodiments, step (c) includes the further steps of comparing the (b) determined change in compressor cycling over time to a reference/stored/baseline/threshold/expected/calculated value. For example a lookup table can be provided which contains a series of reference/stored/baseline/threshold/expected/calculated values. The comparison step then can ascertain whether the (b) determined change in compressor cycling over time is below, above, or the same as any of the values in the lookup table. The comparison of (b) with the lookup table then can reveal information relating to the trajectory of frosting in the freezer and/or can provide a prediction as to the (c) determined time to defrost etc.

Ambient Temperature and Humidity and Freezer Door Openings:

Variables in addition to or other than compressor cycle changes over time can be employed in the mathematical or statistical analysis to provide a more robust estimation of freezer health and/or more robust estimation of when to perform a defrost. Here, the Inventors have discovered, that the rate of ice build (and hence compressor cycle changes over time) is influenced by ambient conditions surrounding the freezer such as temperature and humidity. The Inventors have also discovered that the rate of ice build can also be influenced by the number of opening events (e.g. the number of times the freezer is opened), the duration of time the freezer is open during each opening event in addition to the ambient conditions. Accordingly, the predicted values determined above can be influenced by these ambient conditions and door opening events. Accordingly, the method provides other embodiments where the prediction of defrosting time frame includes incorporating information about the ambient conditions of the room or environment in which the freezer is placed, including, but not limited to the temperature, the absolute humidity, the relative humidity, the air flow characteristics, the altitude, and any other physical and/or environmental variable that can affect the rate of ice buildup inside the freezer.

For example, a freezer located in a tropical climate zone (with high ambient temperature and humidity) can have a higher rate of ice build than a freezer located in a temperate climate zone (with lower ambient humidity and temperature). In these instances, a flat correction factor can be determined for the local climate zone where the freezer is located and the correction factor used to correct or adjust the time period determined in step (c). In another embodiment for a freezer located in a tropical climate zone the determined (c) time period for performing a freezer defrost can be corrected by subtracting a flat amount of days (e.g. 7 days, 14 days, 21 days, 50 days, 100 days etc.) from the (c) determined time period. Alternatively, the ambient temperature and humidity surrounding the freezer can be observed/measured (for example during or along with steps (a) and (b)) and the associated values can be used to either correct the time frame calculated in step (c) or used in the mathematical or statistical analysis used to (c) determine the time period. Separately, or in connection with use of measurements of ambient temperature and humidity, information related to freezer door openings can be used in the (c) determination of a time period for defrosting the freezer OR used as a correction factor to adjust the defrost time frame determined in step (c). Here the frequency and/or number of freezer door openings and/or duration, or average duration, of freezer door openings can be determined. Once this information is available it can be used as a correction factor or in the mathematical or statistical analysis or modeling to (c) determine the defrost time period.

In these preferred embodiments, the method further includes the steps of: observing/measuring/analyzing ambient temperature and/or humidity surrounding the freezer (optionally during the same measurements of step (a)); and using the measured ambient temperature and/or humidity either in step (c) to determine a time frame for a freezer defrost OR as a correction factor to adjust the defrost time frame determined in step (c).

In further preferred embodiments, the method includes the steps of: observing/measuring/analyzing frequency and/or number of freezer door openings and/or duration of freezer door openings, and using the observed door opening information either in step (c) to determine a time frame for a freezer defrost OR as a correction factor to adjust the defrost time frame determined in step (c).

Systems of the Present Invention:

In a preferred embodiment, the present invention provides a system comprising: (a) a freezer having compressor; (b) sensor means for observing compressor cycling (e.g. a sensor capable of performing the measuring and/or analyzing functions described herein to observe compressor cycling): and (c) programmed circuitry for receiving signals from the (b), wherein the circuitry comprises instructions for performing the steps of any method to determine freezer defrost herein described.

In other preferred embodiments, the present invention provides a computer/server/data base/file hierarchy comprising a programmed processor AND/OR programmed circuitry comprising instructions for performing the steps of any method to determine freezer defrost herein described.

In other preferred embodiments, the present invention provide a printed set of instructions comprising printed instructions (or data file containing instructions) for performing the steps of any method to determine freezer defrost herein described.

In other embodiments, the present invention provides a computer, a computer program, a software package, a data file, a module and/or a node programed with logic and/or instructions for performing the steps of any method to determine freezer defrost herein described.

Definitions

A "compressor" is a mechanism that is used to reduce the temperature of a surface, an area, a space, or a volume, both enclosed or not enclosed. As used herein, compressor can mean the apparatus used in refrigerators, freezers, air-conditioning units, or other systems that have an active cooling period and a resting period, for example thermoelectric materials such as Peltiers or thermoelectric coolers (as described in https://en.wikipedia.org/wiki/Thermoelectric_cooling which is attached as Exhibit A for references).

Compressor "cycling" is the turning "on" and "off" of a compressor in response to measured conditions (e.g. measured/sensed temperature). For example, one "cycle" of the compressor can be viewed as the time period starting when the compressor turns on through when the compressor turns off to immediately before the compressor turns on again. The time duration of a cycle may also be called its "period". There are many ways to determine the start, duration, and end of a compressor cycle. Non-limiting examples include the temperature of at least a portion of the interior of a freezer, at least a portion of the interior surface of a freezer, the ambient temperature around the compressor, the temperature of at least a portion of the compressor, noise attributed to the operation of the compressor, temperature in the freezer, and electrical input to the compressor, vibration attributed to the operation of the compressor, etc.

Reference throughout the specification to "one embodiment," "another embodiment," "an embodiment," "some embodiments," and so forth, means that a particular element (e.g., feature, structure, property, and/or characteristic) described in connection with the embodiment is included in at least one embodiment described herein, and may or may not be present in other embodiments. In addition, it is to be understood that the described element(s) may be combined in any suitable manner in the various embodiments.

Numerical values in the specification and claims of this application reflect average values for a composition. Furthermore, unless indicated to the contrary, the numerical values should be understood to include numerical values which are the same when reduced to the same number of significant figures and numerical values which differ from the stated value by less than the experimental error of conventional measurement technique of the type described in the present application to determine the value.

DETAILED DESCRIPTION OF THE FIGURES

FIGS. 1 to 14 show data used in the Exemplary Embodiment section of the application.

Figure 3:
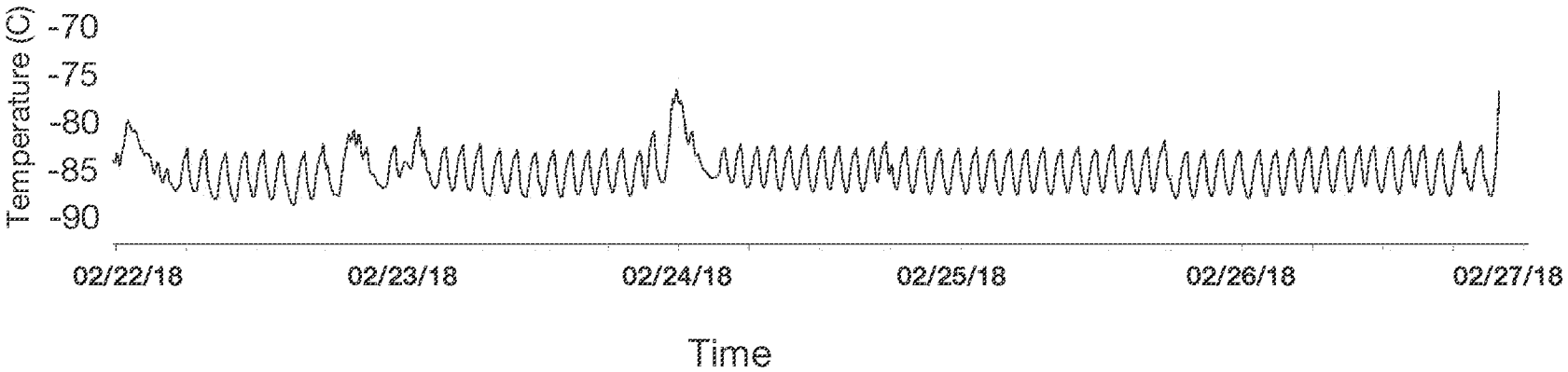
Figure 4:
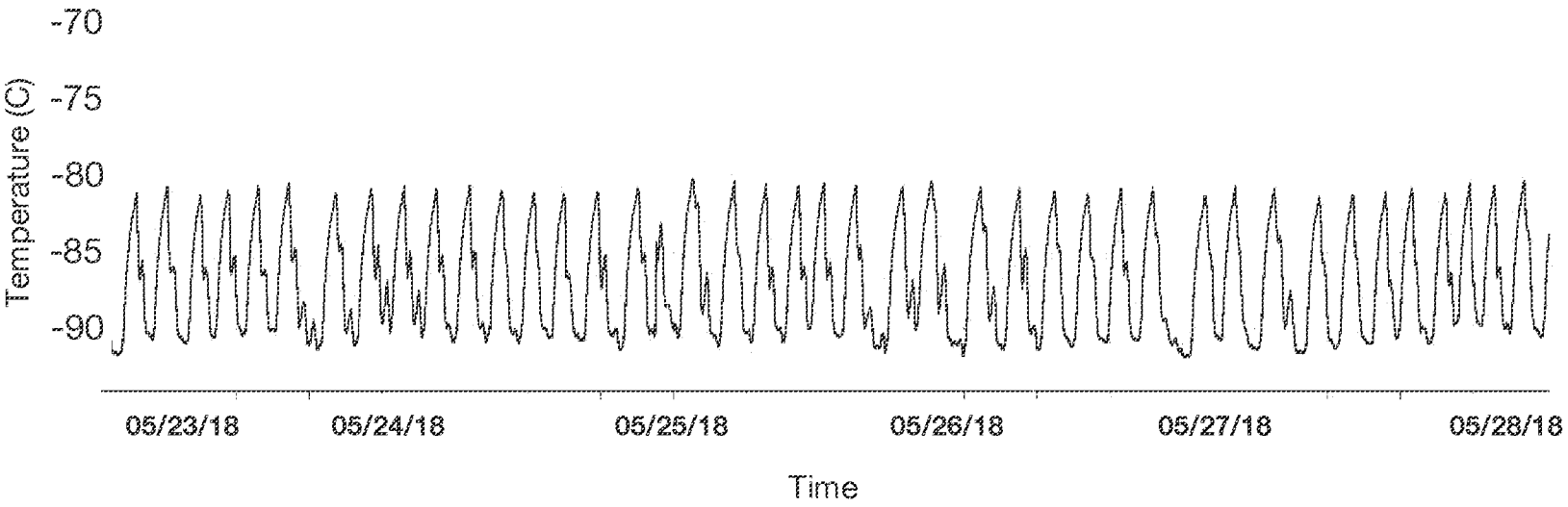
Figure 5:
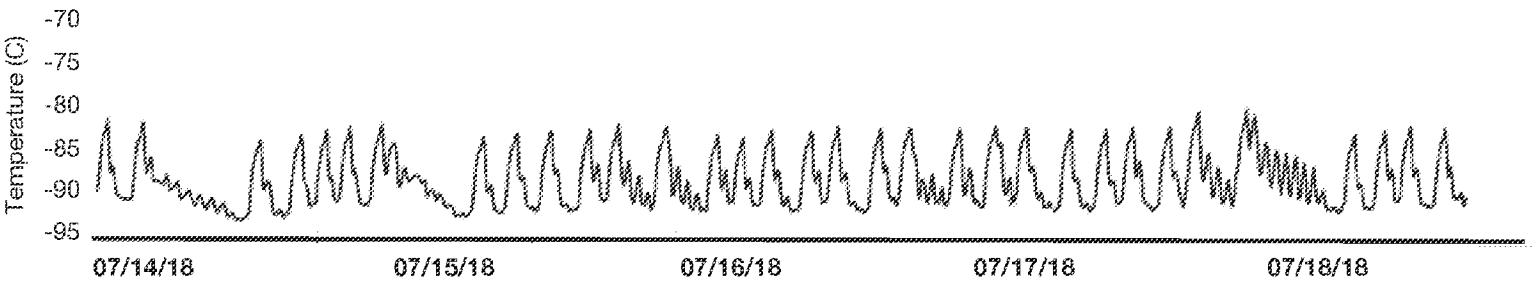
Figure 6:
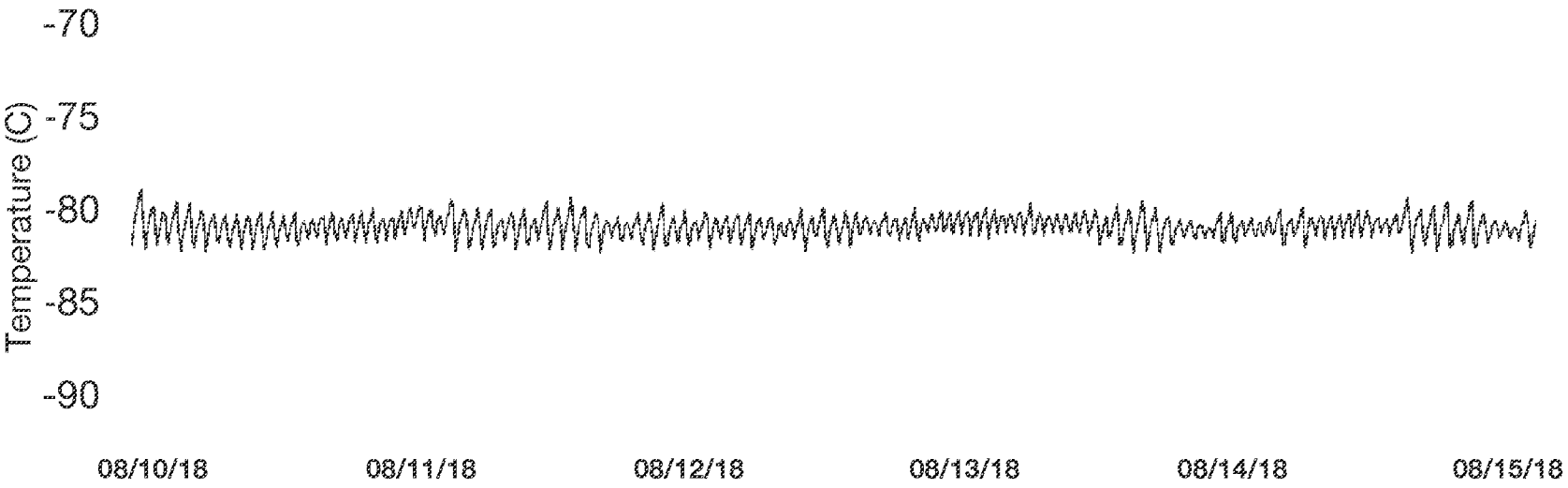

FIGS. 1 to 6 show an exemplary situation where the compressor period and peak to peak temperature values increase over time. Using this information a present or future defrost event can be determined. When a defrost activity 101 is performed, the compressor period and peak to peak temperature variation is reduced, as shown in FIG. 5 and FIG. 6 as well as in FIG. 7 and FIG. 8.

FIG. 1 shows a freezer temperature graph showing changing behavior over time and a defrost period 101 lasting several days. Compressor cycle temperature range increases as well as compressor cycle period (see FIGS. 2-5 for zoomed-in graphs). Also visible are times when the freezer door is opened (and this the temperature increases for a short amount of time). Some of these events are indicated by spikes and labeled 104 in the temperature. A defrost activity was performed prior to data collection in about August 2017.

FIGS. 2-5 show zoomed in snapshots of FIG. 1, highlighting the compressor frequency changes. The time ranges are all equal to 5 days for direct comparison. Additionally, the unshaded area (between the blue and red shaded areas) covers the same temperature range in all Figures. Each snapshot, taken a few months apart, shows a gradual increase in compressor period and temperature range.

Figure 2:
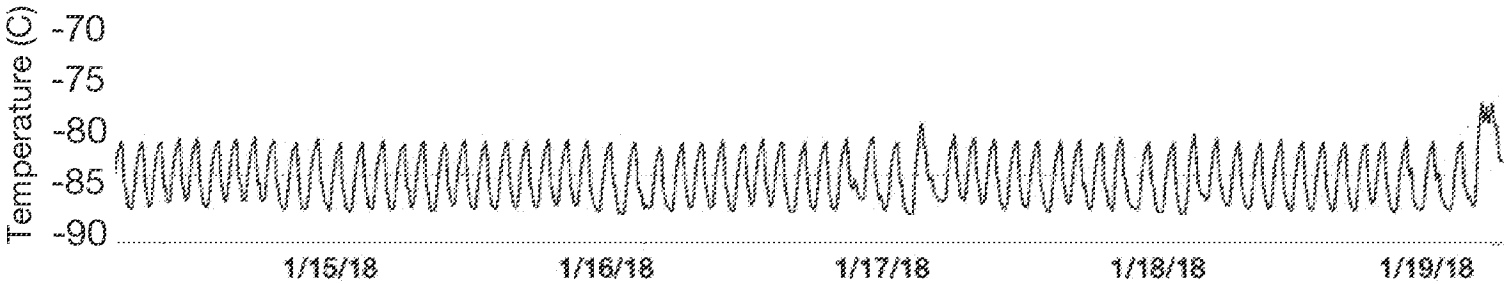
FIGS. 2-8 show zoomed in snapshots of the data provided in FIG. 1.

FIG. 2 shows a zoomed-in section of FIG. 1, specifically the time frame of January 2018 which is approximately 3 months after a defrosting activity was performed. Compressor cycles are approximately 2 hours in length and 8 C in magnitude.

FIG. 3 shows a zoomed-in section of FIG. 1, specifically the time frame of February 2018 which is approximately 5 months after defrosting was performed. Compressor cycles still approximately 2 hours in length and 8 C in magnitude.

FIG. 4 shows a zoomed-in section of FIG. 1, specifically the time frame of May 2018 which is about 8 months after defrosting was performed. Compressor cycles increased in duration and max-min range since last snapshot shown in FIG. 3. Compressor cycles are approximately 3 hours in length and 11 C in magnitude.

FIG. 5 shows a zoomed-in section of FIG. 1, specifically the time frame of July 2018 which is about 10 months after defrosting was performed. Compressor cycles increased in duration and max-min range since last snapshot shown in FIG. 4. Freezer is due for defrost. Compressor is cooling to a lower temperature than previous snapshots. Compressor cycles approximately 3-6 hours in length and 11 C in magnitude.

FIG. 6 shows a zoomed-in section of FIG. 1, specifically the time frame of August 2018 which is immediately after defrosting 101 was performed. Compressor cycles have a significantly shorter period, narrowing temperature range, and are centered around the −80 C set point. Compressor cycles approximately 1 hour in length and 3 C in magnitude.

Figure 7:
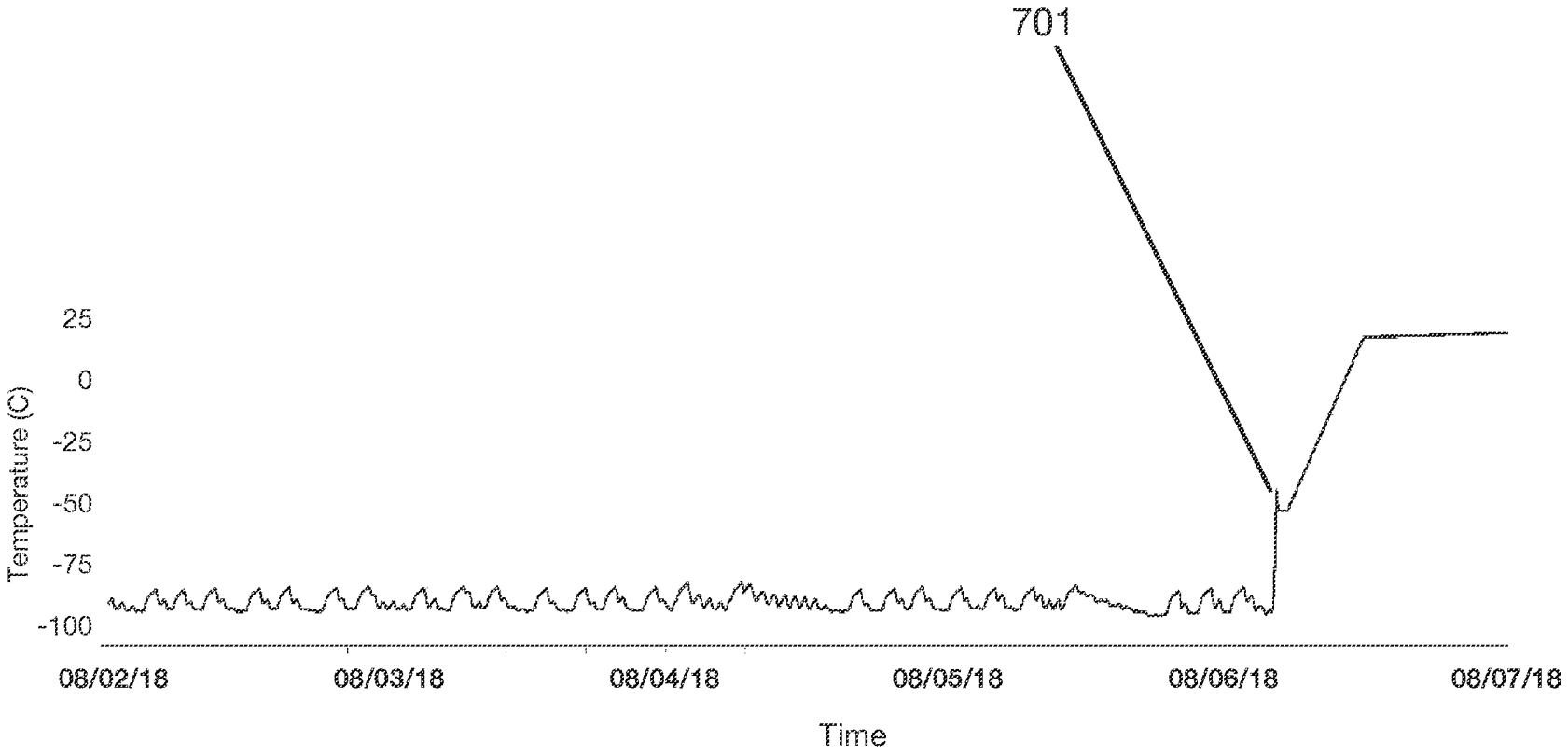

FIG. 7 shows a more zoomed-in representation of the time immediately before defrost activity 101 was performed. The starting of the defrost activity 701 is indicated.

Figure 8:
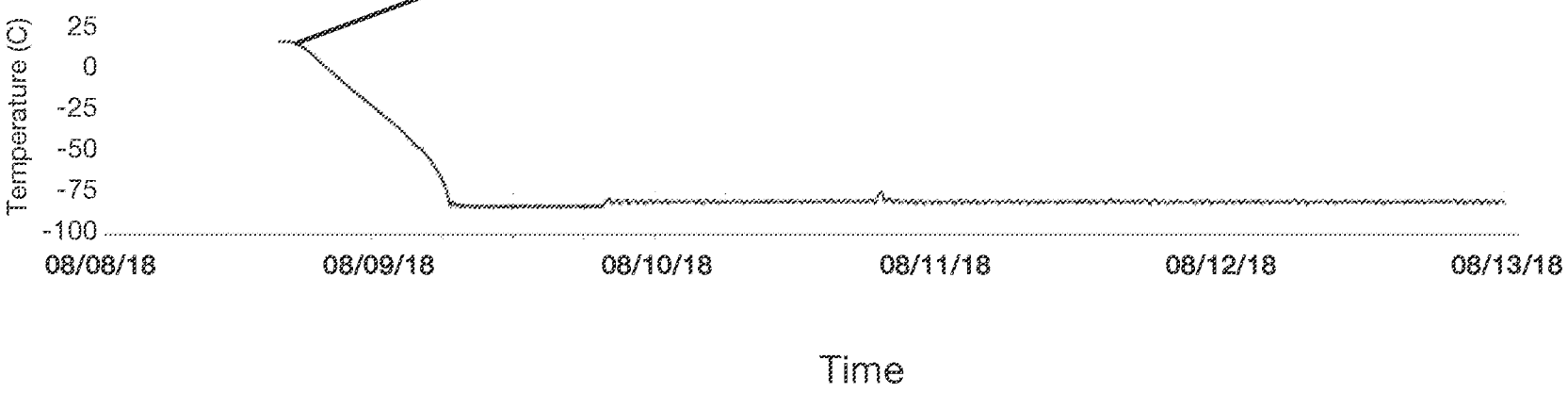

FIG. 8 shows a more zoomed-in representation of the time immediately after defrost activity 101 was performed. The ending of the defrost activity 801 is indicated. It is clear that the defrosting had an immediately positive effect on freezer compressor performance. Compressor cycles have a significantly shorter period, narrowing temperature range, and are centered around the −80 C set point.

Figure 9A:
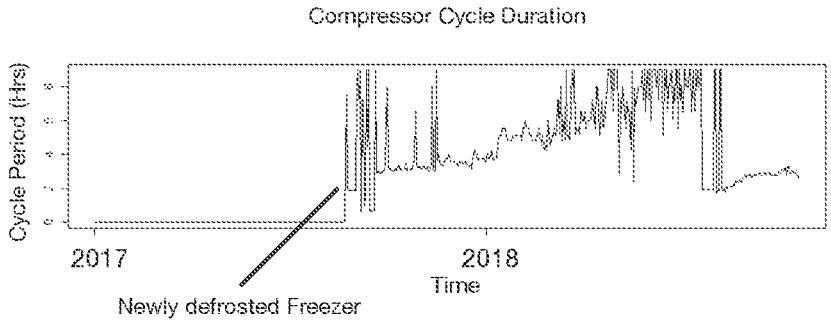
FIG. 9 A shows a daily compressor cycle period in hours.
Figure 9B:
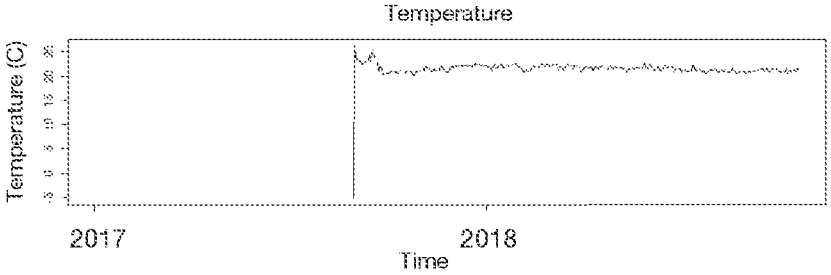
Figure 9C:
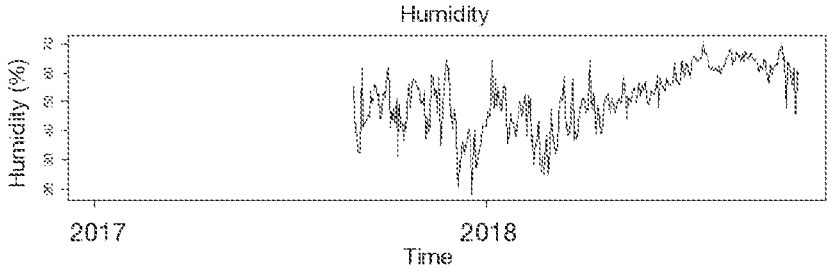

FIG. 9 A shows the daily compressor cycle period in hours. Compressor cycles were calculated daily by calculating the FFT of the temperature and selecting the fundamental frequency. The spikes in the data can be attributed to open door events.

FIG. 9 B shows the ambient temperature in the room containing the freezer.

FIG. 9 C shows the ambient relative humidity in the room containing the freezer.

FIG. 10 shows the compressor period data from FIG. 9A after filtering and smoothing to remove the artifacts from door opening events. The Y Axis (indicated as "Equipment Performance Metric") is the period of the compressor cycle.

FIG. 11 shows the slope of the compressor period (labeled as "Metric" on the Y Axis) vs. day. A value of 0.01 indicates an increase in compressor cycle period of 1 hr every 100 days.

FIG. 12 shows the predicted number of days until the next defrost is needed. As time goes on, the number of days decreases, indicating that the defrost date is approaching. In this data set, the defrost was conducted well after the threshold was first reached, so the estimated days until maintenance reached zero well before the date the maintenance was actually performed by the owners of the freezer.

Figures 13, 13A, 13B, 13C, 13D:
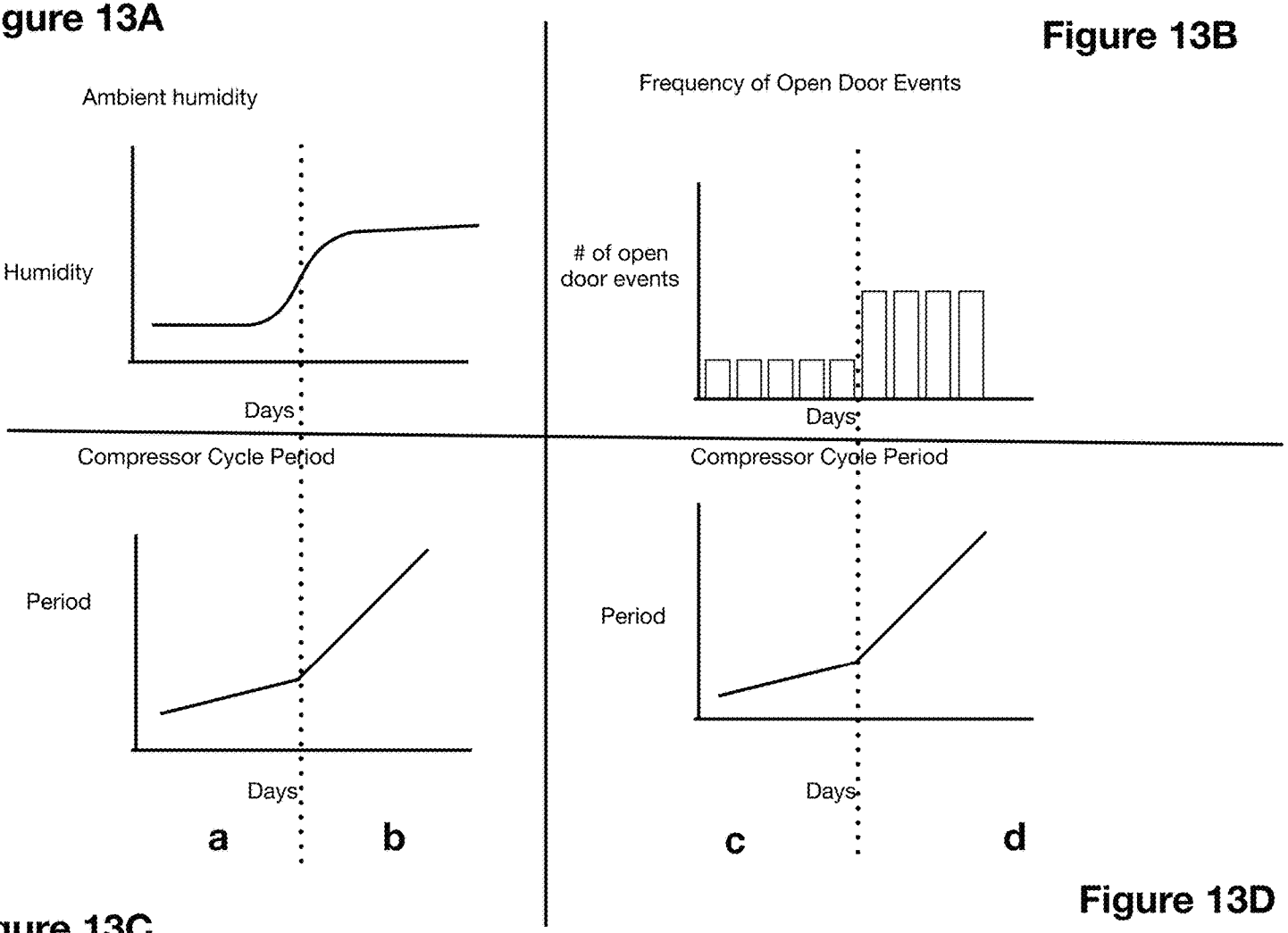
FIG. 13 shows the effects of door openings and the ambient environment on the period of compressor cycles.
FIGS. 13A and 13B show how the ambient humidity in the room where the freezer is operated changes over time.
FIG. 13D show an example embodiment where the number of times the freezer door is opened impacts the rate of increase of the compressor cycle period.

FIG. 13 shows the effects of door openings and the ambient environment on the period of compressor cycles. FIGS. 13A and 13B show an example embodiment of when the ambient humidity in the room where the freezer is operated changes over time. In time period a, the humidity is relatively low (FIG. 13A). During this time a, the compressor cycle period increases at a particular rate. Towards the end of time a and the start of time b, the humidity starts to increase as shown in FIG. 13A. This is subsequently reflected in FIG. 13 C where the compressor cycle period starts to increase at a faster rate. This is an example embodiment of the effect of higher ambient humidity on the rate of ice build up inside a freezer, which subsequently can cause the compressor cycle to increase its period. FIGS. 13B and 13D show an example embodiment where another factor, the number of times the freezer door is opened (and also the duration of the door openings) can have an impact on the rate of increase of the compressor cycle period. In time period c in FIGS. 13B and 13D, the freezer door is opened a relatively low number of times per day. In time period d, the freezer door is opened a relative high number of times per day. Correspondingly, the rate of compressor cycle period increases at a lower rate during time period c, but increases at a higher rate during time period d.

Figure 14:
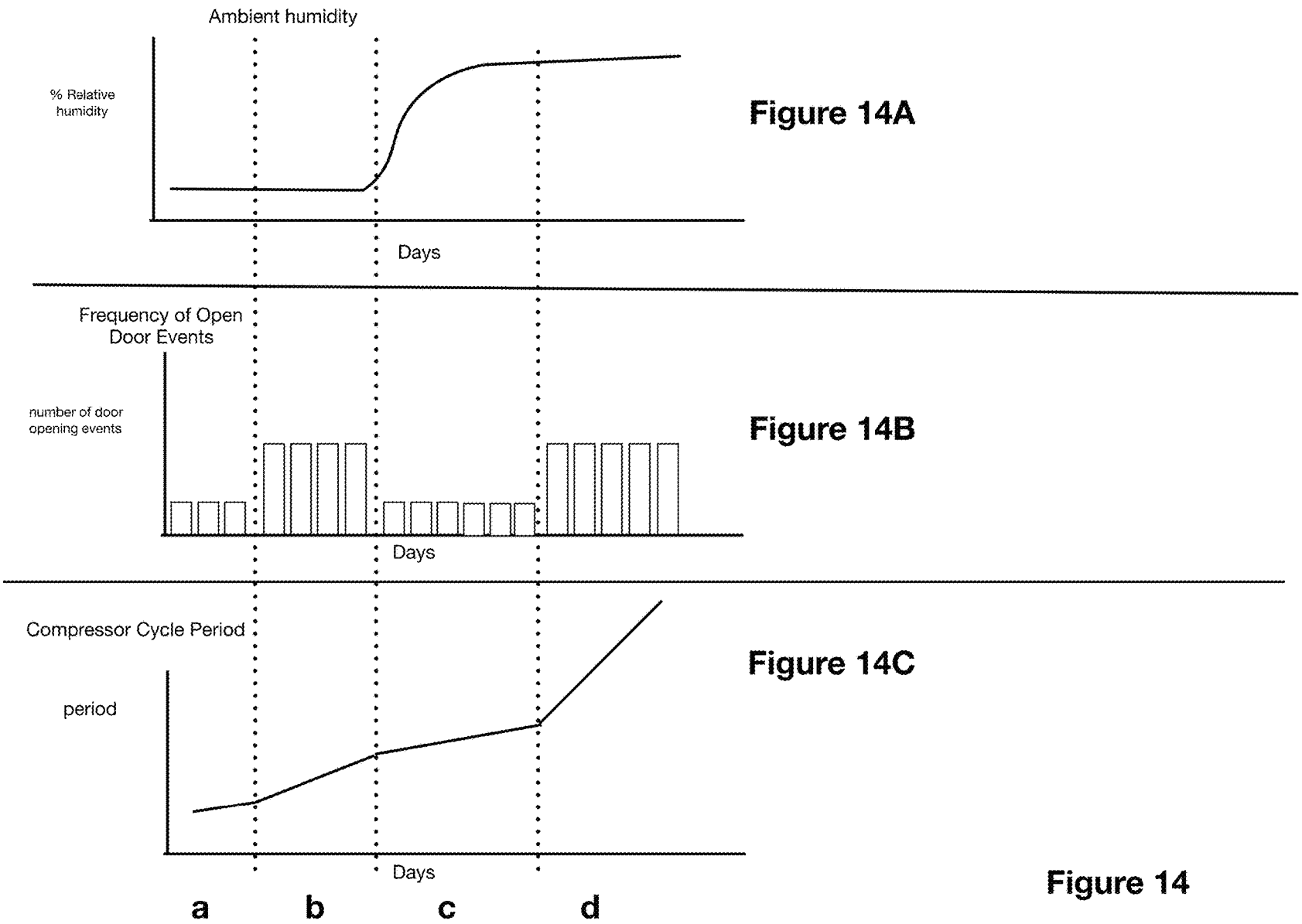
FIG. 14 shows an example situation where both the effects of ambient humidity and the frequency and duration of door opening events can both have an effect on the rate of increase in compressor cycle period.

FIG. 14 shows an example situation where both the effects of ambient humidity and the frequency and duration of door opening events can both have an effect on the rate of increase in compressor cycle period. FIG. 14A shows the ambient humidity at a relatively low level during time periods a and b. This it increases during time period c to a maximum level in time period d. Also during this same set of time periods, FIG. 14B shows the frequency of door opening events. In time period a, there is a relative low number of door opening events. Then in time period b, there is an increased number of door opening events. In time period c, there is a low number of door opening events, and in time period d, there is an increased number of door opening events. The total duration of that the door is opened is related to both the number of times the door is opened and the duration of each opening event. For the same of simplicity, it is assumed that each door opening event is the same duration. One ordinarily skilled in the art shall recognize that each door opening event may have a different duration associated with it. FIG. 14C shows an example embodiment of the effect of both door opening events and ambient humidity on the rate of increase of the compressor cycle period.

Figure 15:
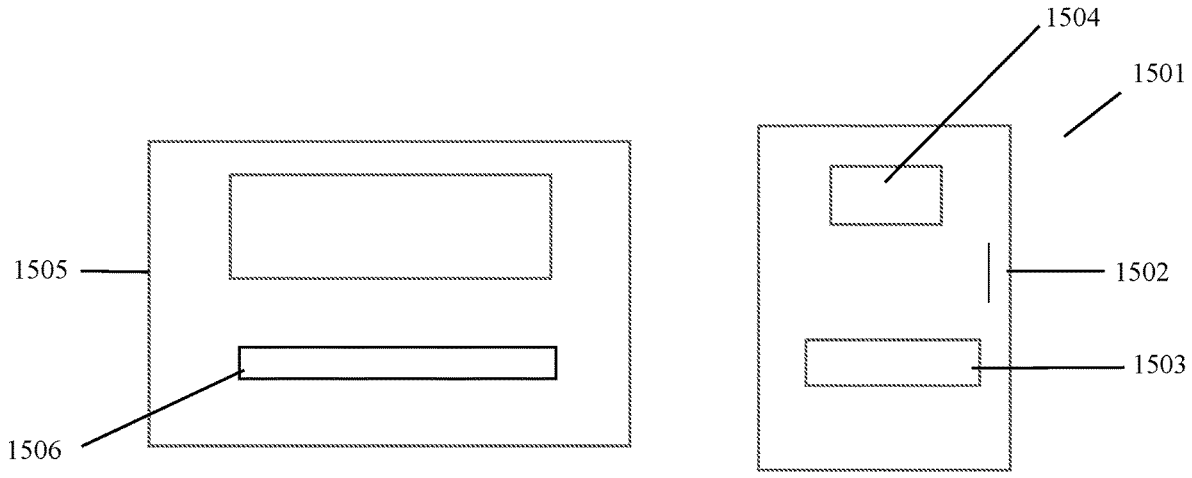
FIG. 15 shows a system having a freezer with a compressor, a sensor means for observing compressor cycling, and a computer having programmed circuitry for performing steps of the methods herein described.

FIG. 15. is a poster presentation which further elaborates on the systems and methods of the present invention.

EXEMPLARY EMBODIMENTS

Using the temperature data from FIGS. 1-8, the compressor behavior can be quantified. FIG. 9A shows the daily compressor cycle period in hours. In this example embodiment, the period of the compressor cycles was calculated on a daily basis by calculating the FFT of the temperature over the course of 24 hours and selecting the fundamental frequency. This is one example embodiment of how to calculate the period of compressor cycles. One ordinarily skilled in the art shall recognize that the period of compressor cycles may be calculated by a variety of methods, including but not limited to the following:

- computing the time duration between peaks of temperature during a specified time window
- computing the time duration between troughs of temperature during a specified time window
- computing the time duration between times of maximum slope, minimum slope, or zero slope of the temperature versus time representation Also, the duration of 24 hours is one example embodiment. One ordinary skilled in the art shall recognize that a different time duration window may be used. For example, 6 hours, 12 hours, 18 hours, one hour, two hours, or any multiple of the previous time periods, including, but not limited to, 2 days, 3 days, 4 days, 5 days, 6 days, 7 days, two weeks, one month, two months, and so on. Furthermore, a value of a representative compressor cycle period may be determined by computing a statistical representation of a given period of time. For example, the mean, median, or mode compressor cycle period may be used. Furthermore, a weighted average of the compressor cycle period may be used based on data collected over a period of time. One ordinary skilled in the art shall recognize that there are many methods to calculate a representative numerical quantity that is indicative of the period of a compressor cycle during a specified period of time.

The spikes in the data that is shown in FIG. 9A can be attributed to open door events. When the door of the freezer is opened, the temperature of the interior of the freezer will tend to move towards the temperature of the ambient room in which the freezer in located, and this is generally reflected as an increase in temperature. Open door events may increase the calculated period if they dramatically increase the temperature, requiring an extra-long cooling time. Conversely, many door openings in a short amount of time may result in an erroneously lower period detected, as the normal compressor cycles will be overwhelmed by the door open spikes. In both case the erroneous cycle periods can be filtered at a later step.

FIG. 9 B shows the ambient temperature in the room containing the freezer. FIG. 9 C shows the ambient relative humidity in the room containing the freezer.

FIG. 10 shows the filtered and smoothed compressor cycle period. Data were filtered using a 10-day sliding window mean+/−2*StdDev filter and smoothed using a 10-day moving average. One ordinarily skilled in the at shall recognize that well known statistical filters may be used.

Furthermore, in this example embodiment, the door opening events are filtered out prior to calculating compressor cycle period.

As can be seen in FIG. 10, the compressor cycle period increases almost 3× over the course of a year, from approximately 3 hours to above 8 hours. Defrosting was performed after the freezer compressor cycle had reached approximately 8.25 hours, and this threshold was used for further calculations as an example embodiment. One ordinarily skilled in the art shall recognize that the above threshold of 8.25 was determined specifically based on this example data set and that other thresholds may be used based on the characteristics of a particular given freezer apparatus.

Furthermore, the above threshold number may be stored in a lookup table and may be, for example, determined as a multiple of a chosen baseline compressor period, for example, 0.5×, 1.5×, 2×, 3×, etc.

Using the filtered and smoothed compressor cycle period from FIG. 10, for each day a linear fit is applied to the data using all available data up to that day. The slope of the fit line (FIG. 11) is used to predict by when the compressor cycle period will reach a given threshold. There is sharp increase in slope around February, which is due to the sharp increase in compressor cycle period in the same time frame. The slope stabilizes around 0.02 after this jump. This linear fit may be calculated over a sliding window Projecting the current compressor cycle period using the above slope, the number of days until the compressor cycle reaches the specified threshold, in this example embodiment 8.25 hours, can be predicted. FIG. 12 shows this prediction for each day. One ordinarily skilled in the art shall recognize that the projection may be performed by linear regression, nonlinear regression, or other time series model fitting technique like ARIMA, ARMA, or RNN models rather than linear regression. As can be see in FIG. 12, the actual defrost maintenance activity was performed later than what was suggested by the model (time 1201) by the owners of this freezer. Once the defrost maintenance was performed 1201, the model predicted approximately 400 days (1202) until the next defrost maintenance was estimated to be needed.

One ordinarily skilled in the art shall recognize that the ambient environment and the number and duration of door openings can impact the rate of ice build up, and therefore impact the rate of compressor cycle period increase over time. FIG. 13 and FIG. 14 illustrate example embodiments of this situation.

FIG. 13 shows the effects of door openings and the ambient environment on the period of compressor cycles. FIGS. 13A and 13B show an example embodiment of when the ambient humidity in the room where the freezer is operated changes over time. In time period a, the humidity is relatively low (FIG. 13A). During this time a, the compressor cycle period increases at a particular rate. Towards the end of time a and the start of time b, the humidity starts to increase as shown in FIG. 13A. This is subsequently reflected in FIG. 13 C where the compressor cycle period starts to increase at a faster rate. This is an example embodiment of the effect of higher ambient humidity on the rate of ice buildup inside a freezer, which subsequently can cause the compressor cycle to increase its period. FIGS. 13B and 13D show an example embodiment where another factor, the number of times the freezer door is opened (and also the duration of the door openings) can have an impact on the rate of increase of the compressor cycle period. In time period c in FIGS. 13B and 13D, the freezer door is opened a relatively low number of times per day. In time period d, the freezer door is opened a relative high number of times per day. Correspondingly, the rate of compressor cycle period increases at a lower rate during time period c, but increases at a higher rate during time period d.

FIG. 14 shows an example situation where both the effects of ambient humidity and the frequency and duration of door opening events can both have an effect on the rate of increase in compressor cycle period. FIG. 14A shows the ambient humidity at a relatively low level during time periods a and b. This it increases during time period c to a maximum level in time period d. Also during this same set of time periods, FIG. 14B shows the frequency of door opening events. In time period a, there is a relative low number of door opening events. Then in time period b, there is an increased number of door opening events. In time period c, there is a low number of door opening events, and in time period d, there is an increased number of door opening events. The total duration of that the door is opened is related to both the number of times the door is opened and the duration of each opening event. For the same of simplicity, it is assumed that each door opening event is the same duration. One ordinarily skilled in the art shall recognize that each door opening event may have a different duration associated with it. FIG. 14C shows an example embodiment of the effect of both door opening events and ambient humidity on the rate of increase of the compressor cycle period.

In time period a in FIG. 14C, the compressor cycle period increases at a relatively low rate. This is expected since the ambient humidity is low (as seen in FIG. 14A during time period) and because the number of door openings is relatively low (as seen in time period a in FIG. 14B). In time period b, the humidity stays low (as seen in FIG. 14A), but the number of times the door is opened increases (as shown in FIG. 14B). This can cause ambient air (which has more humidity than the interior of the freezer) to enter the interior of the freezer and cause ice buildup. This build up occurs at a higher rate due to the increased number of door openings seen in time period b (FIG. 14B) and is reflected in an increased slope as shown in time period b in FIG. 14C. During time period c, the humidity increases (as shown in FIG. 14A), but the number of door openings is back down to the level seen in time period a (as shown in FIG. 14 B). Thus, the rate at which the compressor cycle period increases is higher than in time period a but lower than in time period b (as shown in FIG. 14C). Finally, in time period d, the humidity is at a high level (as shown in FIG. 14A) and the number of door openings is high (as shown in FIG. 14B). Thus, the rate at which the compressor cycle period increases is higher in time period d (as shown in FIG. 14C).

In view of the foregoing, the present invention provides additional embodiments where the number and duration of door opening events and/or the ambient humidity measurements are incorporated into the mathematical and/or statistical prediction model to improve the accuracy and robustness of the (c) determined time period for defrost. By combining the amount of time the doors is open and the humidity during those door opening events, the total water vapor entering the freezer is computed and can be incorporated into the prediction model according to these embodiments.

The location of where a freezer is located can impact the ambient humidity. For example, it is expected that the ambient humidity in Florida may be much higher than in Phoenix, Arizona. As such, the ambient conditions can play a part in the rate of ice buildup inside freezers.

FIG. 15 shows a system 1501 having a freezer 1502 with a compressor 1503, a sensor means 1504 for observing compressor cycling, and a computer 1505 having programmed circuitry 1506 for performing steps of the methods herein described.

Figure 16:
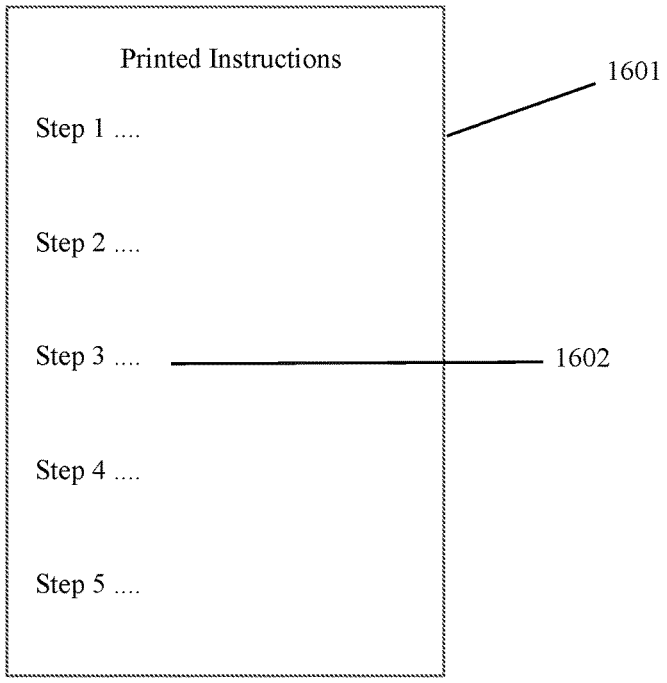
FIG. 16 shows a printed set of instructions for performing steps of the methods herein described.

FIG. 16 shows printed instructions 1601 containing printed instructions 1602 for performing steps of the methods herein described.

The invention claimed is:

1. A method for determining a time frame for when a freezer having a compressor should be defrosted, the method comprising the steps of:

(a) measuring compressor cycling over time;

(b) determining from the compressor cycling measured in step (a) a rate of change in compressor cycling over time; and (c) determining from the rate of change in compressor cycling over time determined in step (b) a time frame for when the freezer should be defrosted.

2. The method of claim 1, wherein an increase in the period of compressor cycles is determined over time; a decrease compressor cycle frequency is determined over time; and/or an increase in the duration in which the compressor is "on" during cycles is determined over time.

3. The method of claim 1, further comprising the step of: sending an alert regarding a value representative of the (c) determined time frame for when the freezer should be defrosted.

4. The method of claim 1, wherein the measure of compressor cycling over time is accomplished by a further step of:

measuring and analysing at least a portion of the interior temperature of the freezer over time;

measuring and analysing electrical input to the compressor over time;

measuring and analysing the ambient temperature of the room surrounding the compressor over time;

measuring and analysing at least a portion of the temperature of the compressor over time;

measuring and analysing sound indicative of compressor cycles over time; and/or measuring and analysing vibration indicative of compressor cycles over time.

5. The method of claim 1, where the time frame determined in step (c) is in the future.

6. The method of claim 1, wherein step (c) includes the further steps of comparing the (b) determined rate of change in compressor cycling over time to a reference value.

7. The method of claim 6, further comprising the step of determining whether the comparison meets or exceeds the reference value.

8. The method of claim 1, wherein the time frame determined in step (c) is a time frame predicted using statistical analysis of the rate of change of compressor cycling determined in step (b).

9. The method of claim 1, further comprising the step of predicting a time frame for defrosting from the determined rate of change.

10. The method of claim 1, wherein the method further comprises the steps:

measuring ambient temperature and/or humidity surrounding the freezer; and using the measured ambient temperature and/or humidity either in step (c) to determine the time frame for a freezer defrost or as a correction factor to adjust the defrost time frame determined in step (c).

11. The method of claim 1, wherein the method further comprises the steps:

measuring frequency and/or number of freezer door openings and/or duration of freezer door openings; and using the observed door opening information either in step (c) to determine the time frame for a freezer defrost or as a correction factor to adjust the defrost time frame determined in step (c).

12. A system comprising:

(a) a freezer having compressor;

(b) sensor means for observing compressor cycling:

(c) programmed circuitry for receiving signals from the (b) sensor means, wherein the circuitry comprises instructions for performing the method steps as described in claim 1.

13. A computer comprising programmed circuitry comprising instructions for performing the method of claim 1.

14. A printed set of instructions comprising printed instructions for performing the method of claim 1.

* * * * *